United States Patent [19]

Matsubara

[11] 3,947,998

[45] Apr. 6, 1976

[54] DUAL SASH WINDOW ASSEMBLY WITH WEATHERTIGHT SEALING MEANS

[75] Inventor: Isamu Matsubara, Nyuzen, Japan

[73] Assignee: Yoshida Kogyo Kabushiki Kaisha, Japan

[22] Filed: Sept. 19, 1974

[21] Appl. No.: 507,480

[52] U.S. Cl. ..... 49/209; 49/404; 49/420; 49/458

[51] Int. Cl.[2] ..... E05D 13/00; E05D 15/06

[58] Field of Search ..... 49/209, 225, 421, 404, 49/458, 415, 420

[56] References Cited

UNITED STATES PATENTS

| | | | |
|---|---|---|---|
| 1,175,713 | 3/1916 | Connolly | 49/415 |
| 1,636,241 | 7/1927 | Polachek et al. | 49/209 |
| 2,084,355 | 6/1937 | Peremi et al. | 49/209 |
| 2,200,548 | 5/1940 | Grady et al. | 49/415 |
| 2,650,387 | 9/1953 | Foss | 49/420 |
| 2,680,269 | 6/1954 | Watkins | 49/420 |
| 3,105,576 | 10/1963 | Jones et al. | 49/458 |
| 3,324,597 | 6/1967 | Rich | 49/458 |
| 3,600,857 | 8/1971 | Barge | 49/404 |
| 3,810,332 | 5/1974 | Grossman | 49/421 |
| 3,837,119 | 9/1974 | Conneally et al. | 49/404 |

FOREIGN PATENTS OR APPLICATIONS

| | | | |
|---|---|---|---|
| 1,121,794 | 7/1968 | United Kingdom | 49/404 |

*Primary Examiner*—Paul R. Gilliam
*Assistant Examiner*—Victor N. Sakran
*Attorney, Agent, or Firm*—Bucknam and Archer

[57] ABSTRACT

In a window assembly having a pair of sashes mounted within a supporting frame for relative horizontal movement, each sash is integrally provided with a pair of opposed rims defining an outwardly open channel along each of its top and bottom horizontal members and along one of its side vertical members which is to be held against one of the jambs of the supporting frame upon closure of the sash. When the sashes are moved to their closed positions, a plurality of vertical rolls mounted in selected positions inside the channels of each sash ride on respective raised roll seats formed on stationary flanges intruding into the respective channels from the supporting frame. Upon resulting lateral displacement of the sashes relative to the supporting frame, sealing strips also arranged internally of the channels become pressed against the flanges.

6 Claims, 7 Drawing Figures

DUAL SASH WINDOW ASSEMBLY WITH WEATHERTIGHT SEALING MEANS

BACKGROUND OF THE INVENTION

This invention relates to a dual sash window assembly or to a window assembly in which a pair of sashes are mounted in parallel, closely spaced planes within a supporting frame for relative horizontal sliding or rolling movement. The invention has particular reference to weathertight sealing means in the dual sash window assembly of the type defined.

The weathertight sealing of window assemblies have been proposed in various forms. However, while windows having only one movable sash can admittedly be sealed relatively easily, it has been considered difficult to seal, in a truly simple and inexpensive manner, windows in which a pair of sashes are both movable relative to each other and to the supporting frame.

SUMMARY OF THE INVENTION

It is therefore an object of this invention to provide a dual sash window assembly comprising a pair of horizontally movable sashes mounted within a supporting frame, in combination with simple, inexpensive and effective sealing means well adapted to make the window assembly weathertight when the sashes are closed.

Another object of the invention is to provide a dual sash window assembly wherein rolls are employed to urge the sashes into pressing contact with sealing strips in their closed positions, and wherein the sashes are completely held out of contact with the sealing strips in other than the closed positions, so that no great manual effort is required to open or close the sashes.

Still another object of the invention is to provide a dual sash window assembly comprising substantially a minimum number of working parts so that the window assembly is easy and economical to manufacture.

According to a feature of this invention, a plurality of vertical rolls are rotatably supported in selected positions within outwardly open channels that are formed, respectively, along the top and bottom horizontal members of each sash and along one of the side vertical members of each sash which is to be held against one of the jams of the supporting frame when the sash is closed. Flanges projecting inwardly from the supporting frame intrude into the respective channels of the sashes, and raised roll seats are formed on the flanges in confronting relationship to the rolls. Upon closure of the window, the rolls ride on the respective raised roll seats, with the result that the sashes are displaced laterally of the supporting frame. Sealing strips arranged internally of the respective channels are then pressed against the flanges for weathertight sealing of the window assembly.

According to another feature of the invention, the rolls and the raised roll seats are so arranged that the pair of sashes are caused to undergo lateral displacement toward each other in their closed positions. This arrangement is particularly advantageous for sealing the lapping or meeting portions of the two sashes.

The foregoing and various other objects, features and advantages of the invention will become more apparent and understandable as the description proceeds hereinbelow, with reference taken to the accompanying drawings which illustrate, by way of example only, some preferred embodiments of the invention and in which like reference characters denote the corresponding parts of the several views.

DESCRIPTION OF THE PREFERRED EMBODIMENTS

Figure 1:
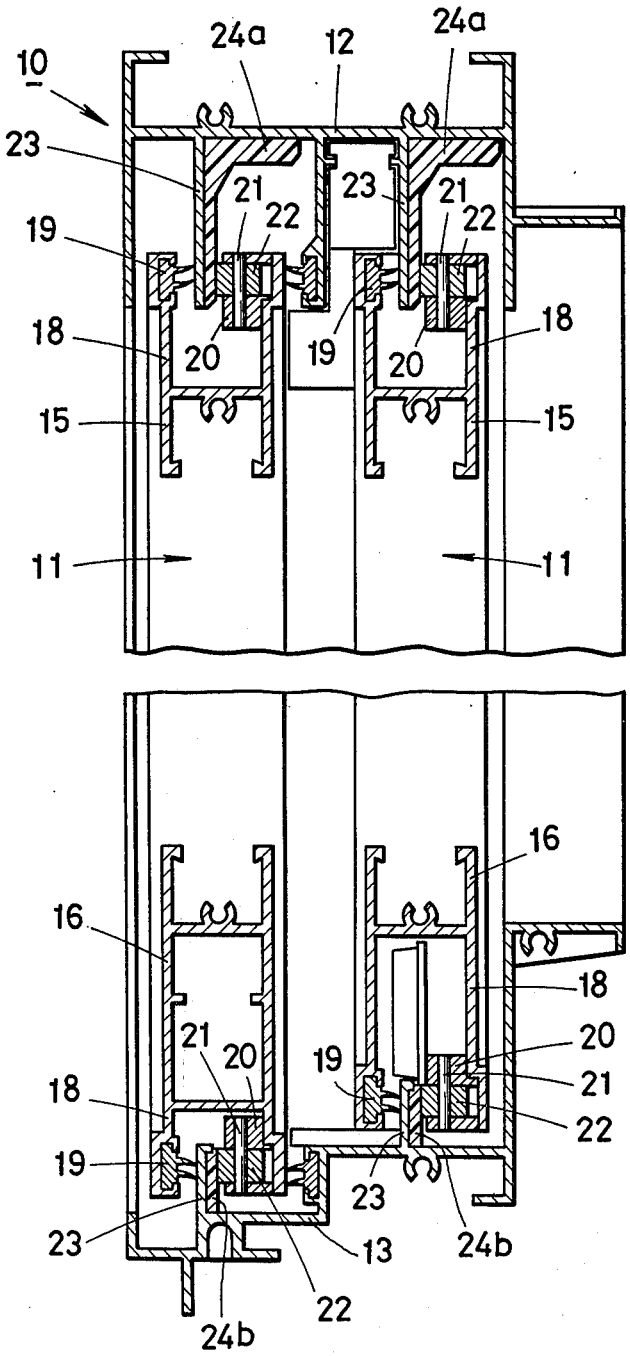
FIG. 1 is a vertical sectional view of a dual sash window assembly constructed in accordance with the novel concepts of this invention.
Figure 2:
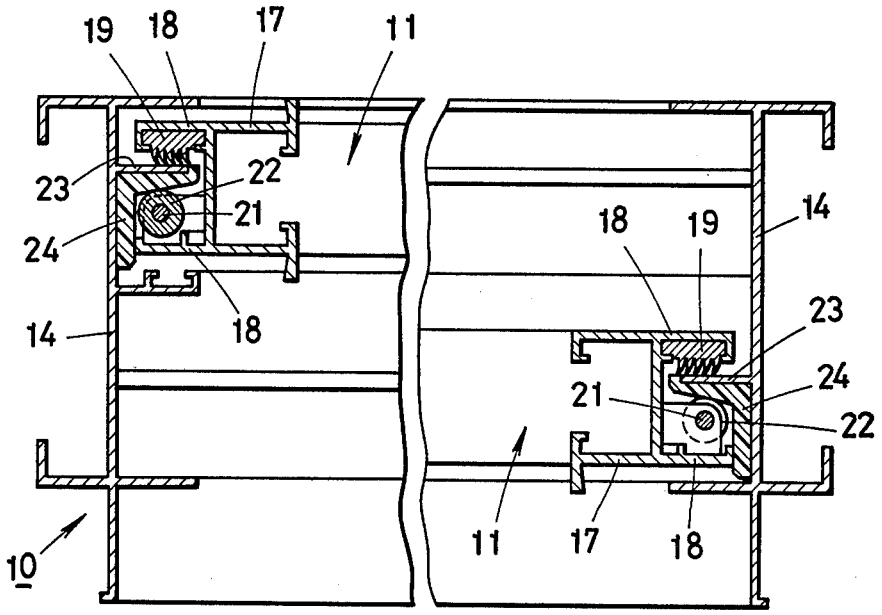
FIG. 2 is a horizontal sectional view of the window assembly shown in FIG. 1.

With particular reference to FIGS. 1 and 2, the dual sash window assembly illustrated therein by way of a preferred embodiment of this invention broadly comprises a generally rectangular supporting frame 10 and a pair of sashes 11 of sliding or rolling type mounted within the supporting frame in parallel, closely spaced planes for relative horizontal movement. The supporting frame 10, which is intended to be rigidly set in the usual window-receiving opeing of a building, consists essentially of a header 12, a sill 13, and jambs 14.

Each sash 11 comprises a top horizontal member 15, a bottom horizontal member 16, and side vertical members 17, those of the side vertical members lying along the lapping or meeting portions of the two sashes being not shown in FIG. 2. Although also unshown in FIGS. 1 and 2, it is understood that each sash 11 has set within its constituent members 15, 16 and 17 a pane or panel of glass or other suitable material. The top and bottom horizontal members 15 and 16 of each sash 11, and one of its side vertical members 17 to be held against one of the jambs 14 when the sash is closed, are each integrally provided with a pair of opposed rims 18 adapted to define an outwardly opening channel which extends throughout the complete length of each sash member 15, 16 and 17.

Supported on the inside surface of one of the opposed rims 18 of each sash member 15, 16 and 17 is a sealing strip 19 of suitable nonmetallic material which extends throughout the complete length of the rim 18 and which includes one or more, two in the illustrated embodiment, tongues projecting laterally therefrom. At lease one, preferably two or three, spaced-apart brackets 20 are supported on the inside surface of the other rim 18 of each sash member. These brackets 20 fixedly carry vertical shafts 21 adapted to rotatably support rolls 22, respectively.

Flanges 23 disposed in the same planes as the sashes 11 project inwardly from the supporting frame 10 and partly intrude into the respective channels between the opposed rims 18 of each sash member 15, 16 and 17. Raised roll seats 24, **24*a* and 24*b*, equal in number to the rolls 22, are supported by the flanges 23 in confronting relationship to the respective rolls. The relative positions of the rolls 22 and the raised roll seats 24, 24*a* and 24*b* are such that the former will ride on the latter when the sashes are moved to their closed positions within the supporting frame 10**, all these roll seats can be conveniently molded of plastics material.

Figure 5:
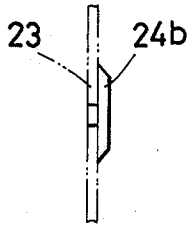
FIGS. 3 to 5 inclusive illustrate the details of raised roll seats used in the window assembly shown in FIGS. 1 and 2.
Figure 4:
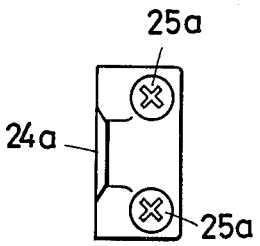
Figure 3:
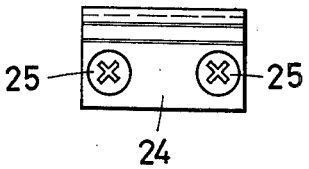

Each of the raised roll seats 24 supported by the flanges 23 projecting from the respective jambs 14 of the supporting frame 10 is of L-shaped cross section, with one of its limbs tapered toward the opposed side vertical member 17 of each sash 11, and is affixed to the supporting frame as by means of slotted-headed screws 25 as shown in FIG. 3. Each of the raised roll seats 24*a* supported by the flanges 23 projecting from the header 12 of the supporting frame is also of L-shaped cross section, with both lateral edges of one of its limbs beveled as shown in FIG. 4, and is likewise affixed to the supporting frame as by means of slotted-headed screws 25*a*. Each of the raised roll seats 24*b* supported by the flanges 23 projecting from the sill 13 of the supporting frame is of flat shape, with both lateral edges thereof beveled as shown in FIG. 5, and is similarly affixed to each flange.

In the dual sash window assembly constructed as hereinbefore described with reference to FIGS. 1 to 5, it will be seen that upon movement of the sashes 11 away from each other to their closed positions, the rolls 22 ride on the respective raised roll seats 24, 24*a* and 24*b*. Thereupon the sashes 11 undergo lateral displacement relative to the outer supporting frame 10, toward the right as viewed in FIG. 1 and downwardly as viewed in FIG. 2, so that the sealing strips 19 of each sash become pressed against the respective flanges 23 thereby weathertightly sealing the gaps between the supporting frame and the sashes. Although the sashes 11 are displaced in the same lateral direction in this particular embodiment of the invention, it will be apparent that the weathertight sealing of the window can likewise be accomplished if the sashes are laterally displaced in opposite directions, as will more clearly appear hereinbelow.

Figure 6:
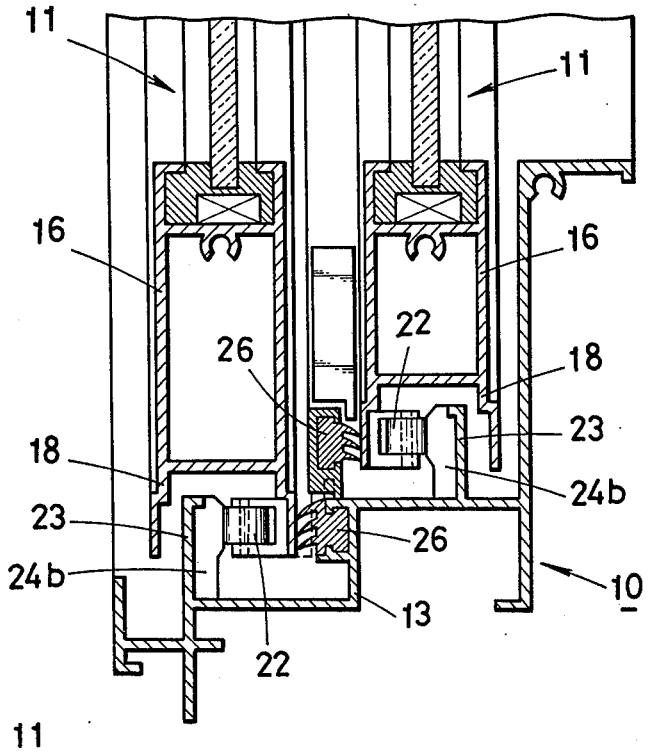
FIG. 6 is a partial vertical sectional view of a dual sash window assembly according to another preferred embodiment of the invention.
Figure 7:
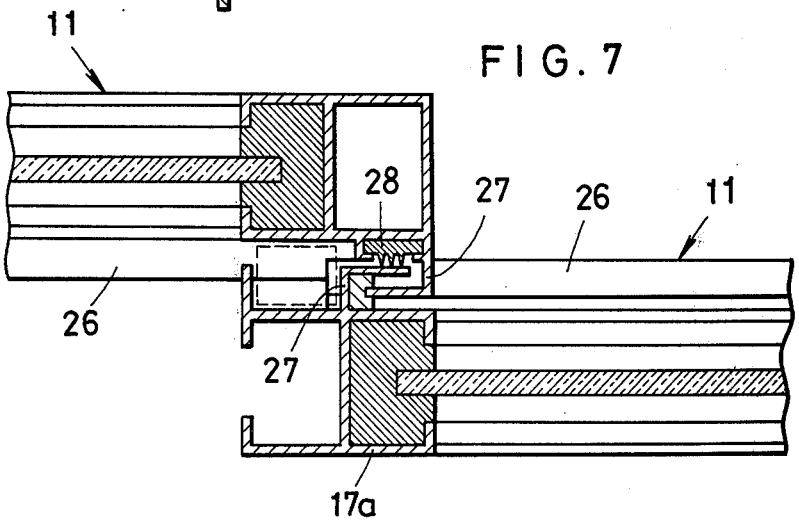
FIG. 7 is a partial horizontal sectional view of the window assembly shown in FIG. 6.

FIGS. 6 and 7 illustrate another preferred embodiment of the invention which is well calculated to ensure weathertight sealing of the lapping portions of the sashes in a dual sash window assembly which is substantially identical in construction with that shown in FIGS. 1 and 2. This second embodiment of the invention, therefore, will be shown and described only in regard to its features distinguishable from the preceding embodiment, the other features being substantially common to both.

As seen in FIG. 6, at least one raised roll seat 24*b* is affixed to the inside surface of each of the flanges 23 projecting inwardly from the sill 13 of the supporting frame 10, the raised roll seats 24*b* being positioned at or adjacent the lapping portions of the sashes 11. Correspondingly, the rolls 22 are rotatably supported on the inside surfaces of the inwardly positioned rims 18 extending downwardly from the bottom horizontal members 16 of the respective sashes 11, in confronting relationship to the respective raised roll seats 24*b*. As in the preceding embodiment, these rolls 22 are so positioned on the rims 18 that they will ride on the respective raised roll seats 24*b* when the sashes are in their closed positions.

As shown, two sealing strips 26 that are identical with the sealing strips 19 of the preceding embodiment are fixedly supported on the sill 13 along the middle of its transverse dimension. The sealing strips 26 are arranged opposite to the respective rims 18 supporting the rolls 22 and extend horizontally throughout the complete lengths of the bottom horizontal members 16 of the sashes 11, respectively.

With reference to FIG. 7, a pair of interlockingly engageable L-shaped flanges 27 are formed on the respective opposed surfaces of the side vertical members 17*2* of the sashes 11 lying along their lapping portions. One of these side vertical members 17*a*, moreover, carries a sealing strip 28, also identical with the sealing strips 19 of the preceding embodiment, which extends vertically throughout the substantially complete length of the side vertical member. This sealing strip 28 is to be pressed against the flange 27 of the other side vertical member 17*a* upon closure of the window, as later described in more detail.

It is understood that the header 12 of the supporting frame 10 and the top horizontal members 15 of the sashes 11 are provided with substantially the same weathertight sealing means as shown in FIG. 6. The jambs 14 of the supporting frame 10 and the opposed side vertical members 17 of the sashes 11 are also understood to be provided with substantially the same weathertight sealing means as shown in FIG. 2 except for the fact that both side vertical members 17 are caused to move laterally inwardly of the frame 10 in the closed positions of the sashes.

The second preferred embodiment of the inventing being constructed as above set forth in connection with FIGS. 6 and 7 in particular, the rolls 22 ride on the respective raised roll seats 24*b* at or adjacent the lapping portions of the sashes 11 upon movement of the sashes to their closed positions. The rolls 22 mounted on the side vertical members 17 of the sashes also ride on the respective raised roll seats 24 on the jambs 14 of the supporting frame 10. As a consequence, the sashes 11 become laterally displaced toward each other relative to the frame 10, so that the sealing strips 26 become pressed against the respective opposed rims 18 along the top and bottom horizontal members 15 and 16 of the sashes. The sealing strip 28 extending along the side vertical member 17*a* of one of the sashes also becomes pressed against the L-shaped flange 27 on the side vertical member 17*a* of the other sash to seal the lapping portions of the two sashes. Since the sealing strips arranged along the side vertical members 17 of the sashes become simultaneously pressed against the respective flanges projecting inwardly from the jambs 14 of the supporting frame 10, the weathertight sealing of the complete window assembly can be realized.

Although the dual sash window assembly according to the invention has been shown and described hereinbefore in very specific aspects thereof, it is to be understood that the invention itself is not to be restricted by the exact showing of the accompanying drawings or the description thereof. For example, instead of mounting the rolls on the rims of the sashes and the roll seats on the flanges of the supporting frame as in the embodiments herein disclosed, the rolls may be mounted on the flanges and the roll seats on the rims. This and other modifications within the broad teachings of the invention are intended in the foregoing disclosure. It is therefore appropriate that the invention be construed broadly and in a manner consistent with the fair meaning or proper scope of the following claims.

What is claimed is:

1. In a dual sash window assembly comprising a supporting frame including a header and a sill and jambs, and a pair of horizontally movable sashes mounted within said supporting frame in parallel spaced planes, each of said sashes including top and bottom horizontal members and side vertical members, the combination thereof with:

means defining outwardly open channels along said top and bottom horizontal members of each sash and along one of said side vertical members of each sash which is to be held against one of said jambs of said supporting frame when the sash is in a closed position;

a plurality of vertical rolls rotatably supported in selected positions internally of said channels;

a plurality of flanges projecting inwardly from said supporting frame and intruding into said channels, respectively, when said sashes are in their closed positions;

a plurality of raised roll seats formed on said flanges in such positions that said rolls ride on said roll seats, respectively, when said sashes are moved to their closed positions, whereby said sashes undergo lateral displacement relative to said supporting frame; and a plurality of sealing strips arranged internally of said channels whereby said sealing strips become pressed against said flanges, respectively, upon lateral displacement of said sashes in their closed positions.

2. The dual sash window assembly as recited in claim 1, wherein at least one of said rolls in positioned in each of said channels of each sash.

3. The dual sash window assembly as recited in claim 1, wherein said sashes undergo displacement in the same lateral direction with respect to said supporting frame in their closed positions.

4. In a dual sash window assembly comprising a supporting frame including a header and a sill and jambs, and a pair of horizontally movable sashes mounted within said supporting frame in parallel spaced planes, each of said sashes including top and bottom horizontal members and side vertical members, said side vertical members consisting of a first side vertical member to be held against one of said jambs of said supporting frame when the sash is in a closed position and a second side vertical member to meet the corresponding side vertical member of the other sash when the two sashes are in their closed positions, the combination thereof with:

means defining outwardly open channels along said top and bottom horizontal members and said first side vertical member of each sash;

a plurality of vertical rolls rotatably supported in selected positions internally of said channels;

a plurality of flanges projecting inwardly from said supporting frame and intruding into said channels, respectively, when said sashes are in their closed positions;

a plurality of raised roll seats formed on said flanges in such positions that said rolls ride on said roll seats, respectively, when said sashes are moved to their closed positions;

said rolls and said roll seats on each of said sashes being so arranged that said sashes undergo lateral displacement toward each other relative to said supporting frame when said sashes are moved to their closed positions;

first sealing strips arranged along said header and sill of said supporting frame in the middle of the transverse dimension thereof whereby said top and bottom horizontal members of said sashes become pressed against said first sealing strips, respectively, upon lateral displacement of said sashes in their closed positions;

a second sealing strip arranged along said second side vertical member of one of said sashes whereby said second side vertical member of the other sash becomes pressed against said second sealing strip upon lateral displacement of said sashes in their closed positions; and third sealing strips arranged internally of said channels along said first side vertical members of said sashes whereby said third sealing strips become pressed against the respective flanges intruding into the respective channels along said first side vertical members upon lateral displacement of said sashes in their closed positions.

5. The dual sash window assembly as recited in claim 4, wherein at least one of said rolls is positioned in each of said channels of each sash, and wherein those of said rolls positioned in the channels along said top and bottom horizontal members of each sash are adjacent the lapping portions of said sashes.

6. The dual sash window assembly as recited in claim 4, further including a pair of interlockingly engageable flanges arranged along said second side vertical members of said sashes, respectively, said second sealing strip being pressed against one of said flanges upon lateral displacement of said sashes in their closed positions.

* * * * *